US006978898B2

(12) United States Patent
Carlucci et al.

(10) Patent No.: US 6,978,898 B2
(45) Date of Patent: Dec. 27, 2005

(54) HAIR SETTING ASSEMBLY

(75) Inventors: Vito James Carlucci, Stratford, CT (US); Daniel Santhouse, Wilton, CT (US); Richard Neil Tobin, Stamford, CT (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 10/040,944

(22) Filed: Jan. 9, 2002

(65) Prior Publication Data

US 2003/0127347 A1 Jul. 10, 2003

(51) Int. Cl.[7] ..... A45D 4/00

(52) U.S. Cl. ..... 206/581; 132/229; 206/823; 219/222; 220/629

(58) Field of Search ..... 206/349, 581, 206/823; 132/229; 219/222; 220/629, 630; D28/38; 108/26; 248/133–143; 312/249.1, 312/249.7, 270.1, 270.2, 270.3, 307

(56) References Cited

U.S. PATENT DOCUMENTS 2,659,920 A * 11/1953 Bogan et al. ..... 132/73.5
2,663,392 A * 12/1953 Miller ..... 190/12 R
2,748,952 A * 6/1956 Fleit et al. ..... 211/74
3,282,462 A * 11/1966 Box ..... 220/826
D206,982 S 2/1967 Giacchero ..... D86/10
3,410,985 A 11/1968 Giacchero ..... 219/222
D216,349 S 12/1969 Bomeisler et al. ..... D86/10
3,567,063 A 3/1971 Kovach ..... 220/29
3,586,820 A * 6/1971 Yamanaka ..... 219/222
D221,603 S 8/1971 Levin ..... D86/10
3,700,853 A * 10/1972 Jensen et al. ..... 219/222
D227,316 S 6/1973 MacKenzie ..... D86/10 E
D228,040 S 7/1973 Wolff ..... D86/10 E
3,979,007 A * 9/1976 Thornbloom, Jr. ..... 220/522
D256,509 S 8/1980 Ryan ..... D28/38
D289,091 S 3/1987 Skovdal ..... D28/38
4,661,683 A 4/1987 Glucksman ..... 219/222
4,816,644 A 3/1989 Frank ..... 219/271
D313,285 S 12/1990 Montagnino et al. ..... D28/38
D317,215 S 5/1991 Montagnino et al. ..... D28/38
5,051,725 A * 9/1991 Caccitolo ..... 340/571
D323,041 S 1/1992 Montagnino et al. ..... D28/38
D332,155 S 12/1992 Wistrand ..... D28/38
D363,140 S 10/1995 Accumanno et al. ..... D28/38

* cited by examiner

*Primary Examiner*—Jim Foster
(74) *Attorney, Agent, or Firm*—Lawrence Cruz; Steven A. Garner

(57) ABSTRACT

There is provided a hair setting assembly having a split top lid for improving heat conservation. The assembly also has a tilt adjustable housing that holds a set of hair rollers and encloses an electrical means for heating the rollers.

8 Claims, 6 Drawing Sheets

HAIR SETTING ASSEMBLY

BACKGROUND OF THE INVENTION

1. Field of the Invention

The present invention relates to personal care appliances. More particularly, the present invention relates to hair setting assemblies for holding and heating hair rollers. The present invention relates even more particularly to a hair setting assembly with a split top lid and a tiltable housing.

2. Description of the Prior Art

Devices for heating hair curlers are well known. A typical hair setting assembly has a housing with a number of electrically heated vertical elements and a number of rollers, generally of different size, disposed on the vertical elements. The rollers are usually provided with a hair gripping outer surface with a thermally insulated portion to allow handling without burning the user's fingers. The inner portion of each roller is usually made of a highly conductive material to facilitate heat transfer from the electrically heated vertical elements to the rollers. A lid, that serves to cover the rollers and retain heat during the warming process, closes the housing. A problem with this conventional configuration is that too much heat is lost when the lid is opened to access the rollers. Also, hair setting assemblies incorporating a steam boiler heating system, as a result of the heating process, tend to collect significant amounts of hot condensed water on the inner surface of the lid. When the lid of such a device is opened during the heating process or thereabouts, which is typical in use, the condensed water tends to spill off the lid and onto the hands of a user and the rollers, potentially burning the user and damaging the rollers. In addition, should a significant amount of water condensation collect on the inner surface of the lid, the condensation can drip off the lid and into the electrical disclosure and wet the insulation disposed therein, thereby creating a shock hazard. These drawbacks are overcome in the hair setting assembly of the present invention.

SUMMARY OF THE INVENTION

It is an object of the present invention to provide a hair setting assembly for heating hair rollers used to curl hair.

It is another object of the present invention to provide a hair setting assembly with a housing that is sleek and lightweight.

It is still another object of the present invention to provide a hair setting assembly having a lid that is partitioned into at least two sections for improving heat conservation.

It is yet another object of the present invention to provide a hair setting assembly in which the at least two sections of the lid are configured to collect condensation from the inner surface of the lid and direct the condensation into one or more reservoirs in the housing.

It is a further object of the present invention to provide a hair setting assembly with a tilt adjustable housing to facilitate access to the heated rollers.

These and other objects and advantages of the present invention are achieved by a hair setting assembly of the present invention. The hair setting assembly has a housing with one or more supports for supporting one or more heatable curlers or rollers, a lid divided into at least two sections that are pivotally connected to the housing, and a stand or base.

The at least two sections of the lid are each separately connected to the housing. This aspect allows for selective access to the heated rollers. This selective access helps to reduce the loss of heat and thus improves efficiency. Also, each of the at least two lid sections are configured to collect any condensation that accumulates commonly on the under surface of each section and direct it, when the lid section is opened, into one or more reservoirs disposed in the housing.

In an alternative embodiment, the base is connected to the housing such that the housing can be tilted about an axis in a forward direction through a specified angle. This tilting action facilitates access to the heated rollers and reduces the risk of a user being burned.

BRIEF DESCRIPTION OF THE DRAWINGS

The present invention is more fully understood by reference to the following detailed description of a preferred embodiment in combination with the drawings identified below.

DETAILED DESCRIPTION OF THE INVENTION

Figure 1:
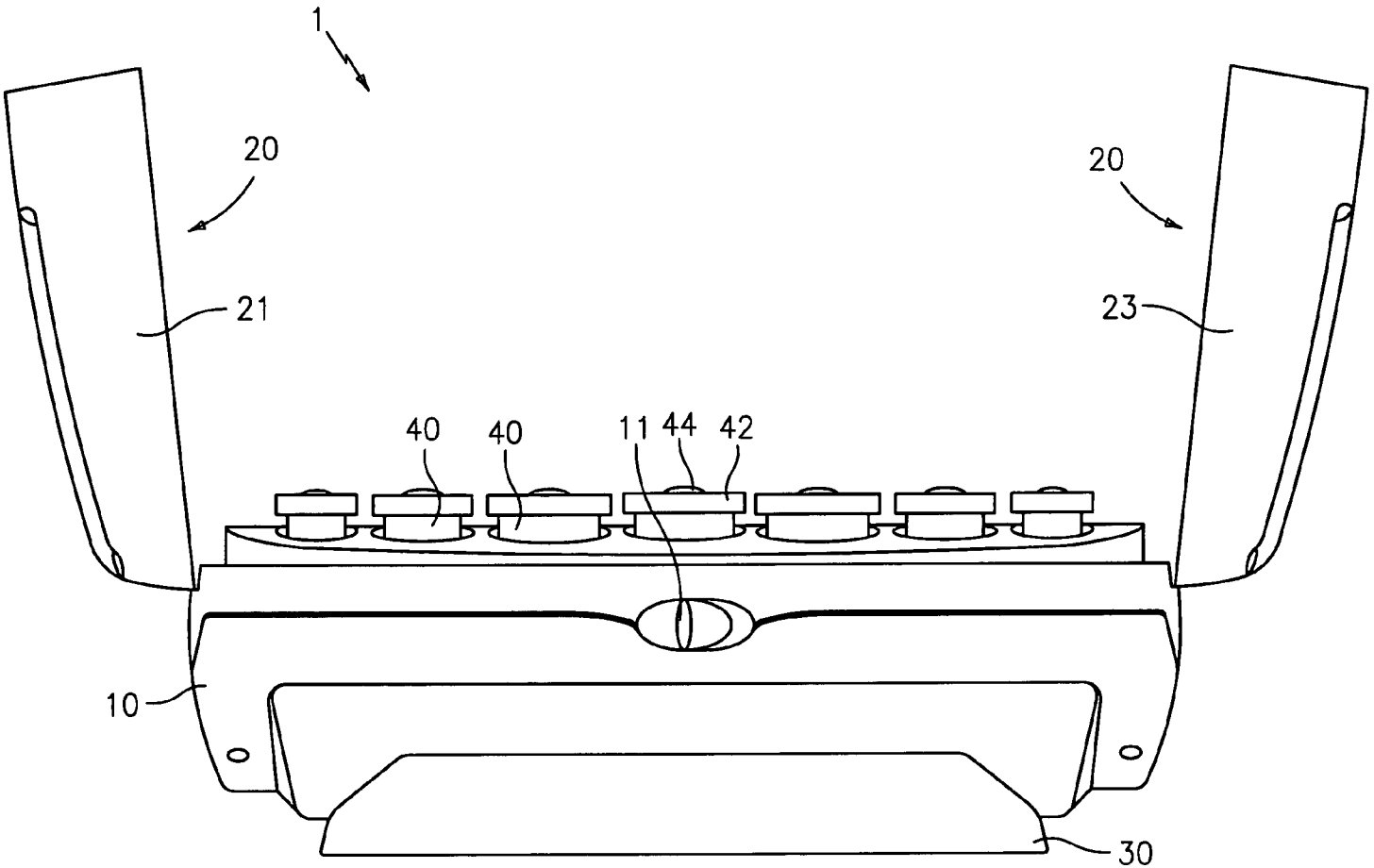
FIG. 1 is a front view of a hair setting assembly, showing the lid in an opened position in accordance with a preferred embodiment of the present invention.

Referring to the drawings and, in particular, FIG. 1, there is shown a hair setting assembly in accordance with a preferred embodiment of the present invention generally represented by reference numeral 1. The hair setting assembly 1 preferably has a housing 10, a stand or base 30, and a split top lid 20 divided into at least two sections. The assembly 1 may also have one or more supports 45 for supporting one or more heatable curlers or rollers 40. Preferably, lid 20 has a first section 21 and a second section 23, each pivotally connected to housing 10.

Figure 7:
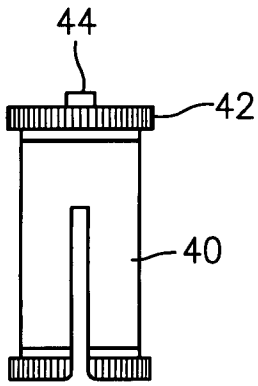
FIG. 7 is a hair curler for use in the hair setting assembly.
Figure 6:
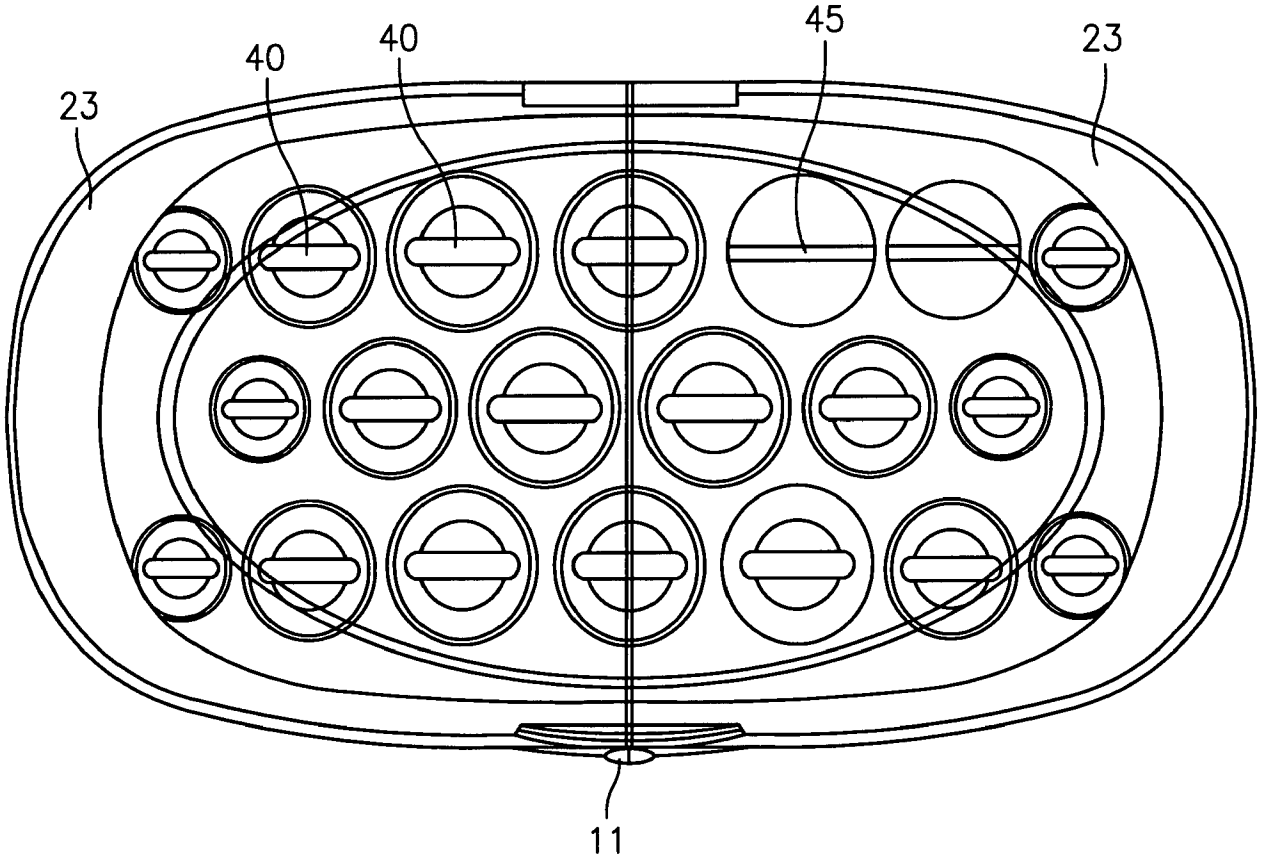
FIG. 6 is a top view of the hair setting assembly of FIG. 1.

Housing 10 preferably encloses at least one reservoir (not shown). Preferably, housing 10 also encloses one or more heat conductive supports, shown in FIG. 6, that has a heating resistor mechanism that is connectable to a power source (not shown). Preferably, the one or more heat conductive supports each sandwich a resistance heater (not shown) and are arranged or tilted on edge to engage rollers 40 directly. Preferably, as shown in FIG. 7, rollers 40 are forked over the edges of the heat conductive supports. It is noted that other configurations and adaptations may also be used to accomplish the same purposes of the arrangement just described. For example, a single heating plate provided on its top surface with one or more heat conducting elements protruding from the top surface for engagement with rollers 40 may also be used.

Rollers 40 preferably have an inner casing or surface of conductive material and an outer casing or surface of non-conductive material. The inner surface facilitates heat transfer from the conductive elements, as well as heat storage. The outer surface preferably optimizes the amount and effect of heat transferred from the conductive element to enhance the hair curling effect and allow handling by a user without the danger of burning the skin. As clearly shown in FIG. 1, each roller 40 preferably has a non-conductive cap 42 and a tab 44 to facilitate handling and further reduce the likelihood of the skin being burned.

As discussed above, split top lid 20 is preferably divided into at least two sections, first section 21 and second section 23. Preferably, first section 21 is the same extent as second section 23. Lid 20 may also be divided into three or more sections (not shown).

Figure 2:
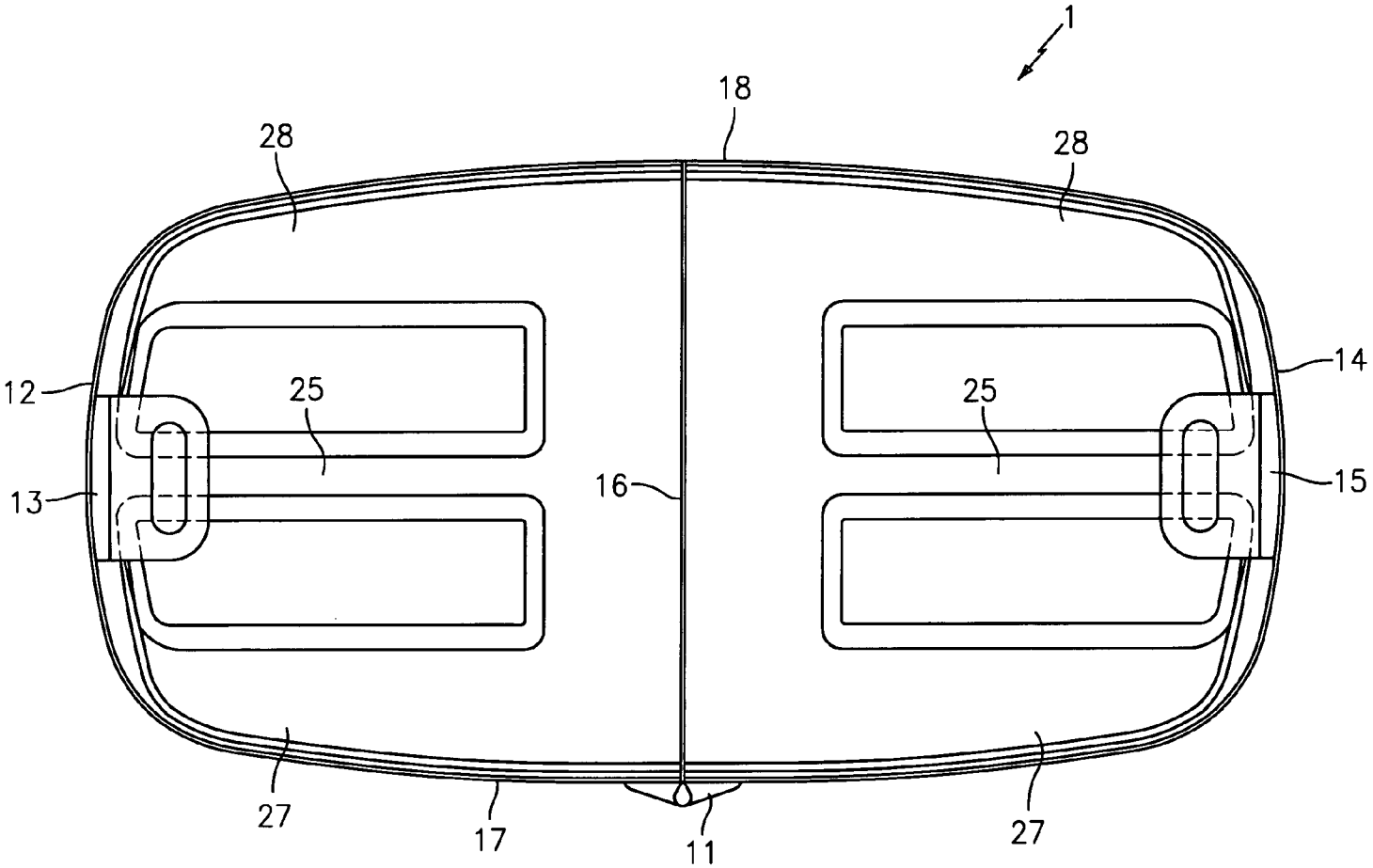
FIG. 2 is a top view of the hair setting assembly of FIG. 1.

Referring to FIG. 2, first section 21 preferably is pivotally connected at a first edge 12 of housing 10 by a first connector 13, and second section 23 preferably is pivotally connected at a second edge 14 of housing 10 by a second connector 15. Also, should split lid 20 be divided into three or more sections, preferably each additional section would be similarly pivotally connected to a rear edge 18 of housing 10.

Preferably, first section 21 and second section 23 seal along a mid-line 16 that runs from a front edge 17 of housing 10 to rear edge 18. First connector 13 and second connector 15 are preferably located at opposing ends of housing 10. Should lid 20 include three or more sections, preferably each of the three or more sections will cooperate to selectively cover rollers 40.

Figure 3:
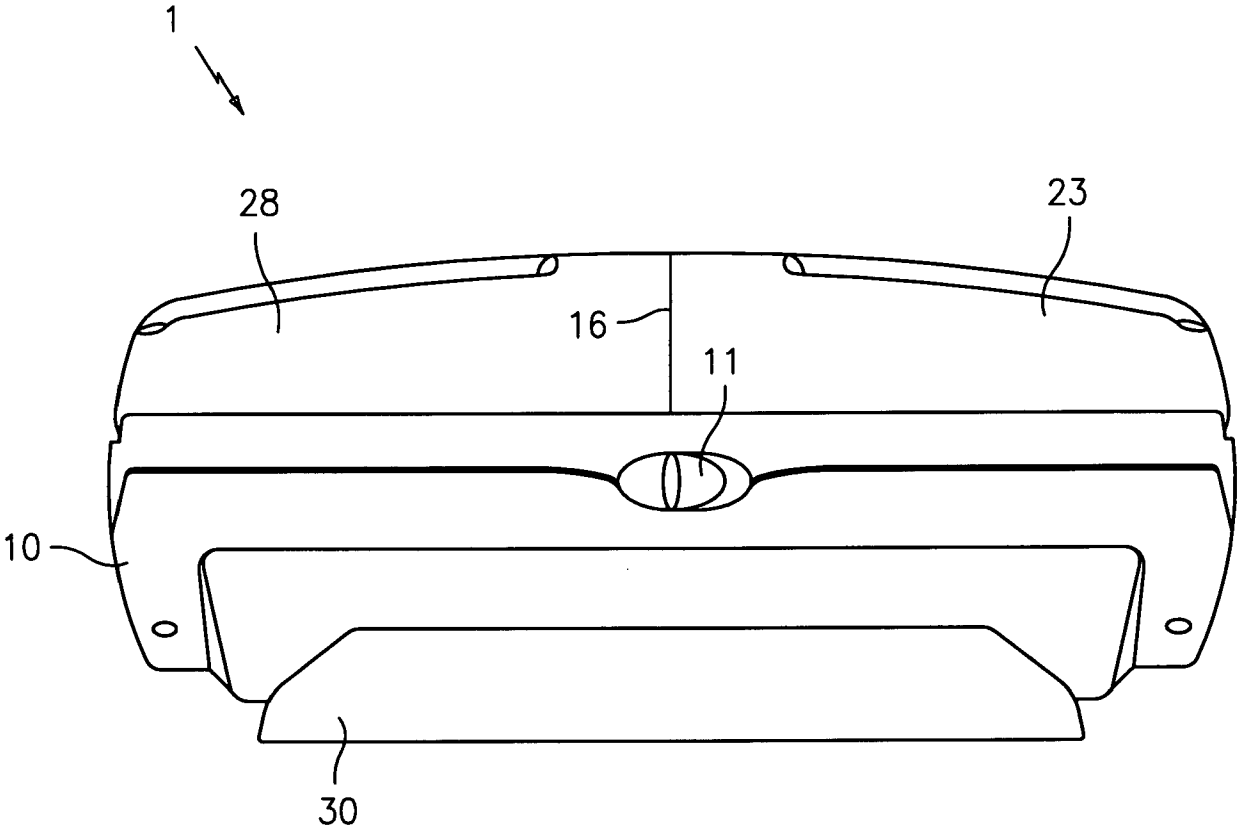
FIG. 3 is a front view of the hair setting assembly of FIG. 1, showing the lid in a closed position.
Figure 4:
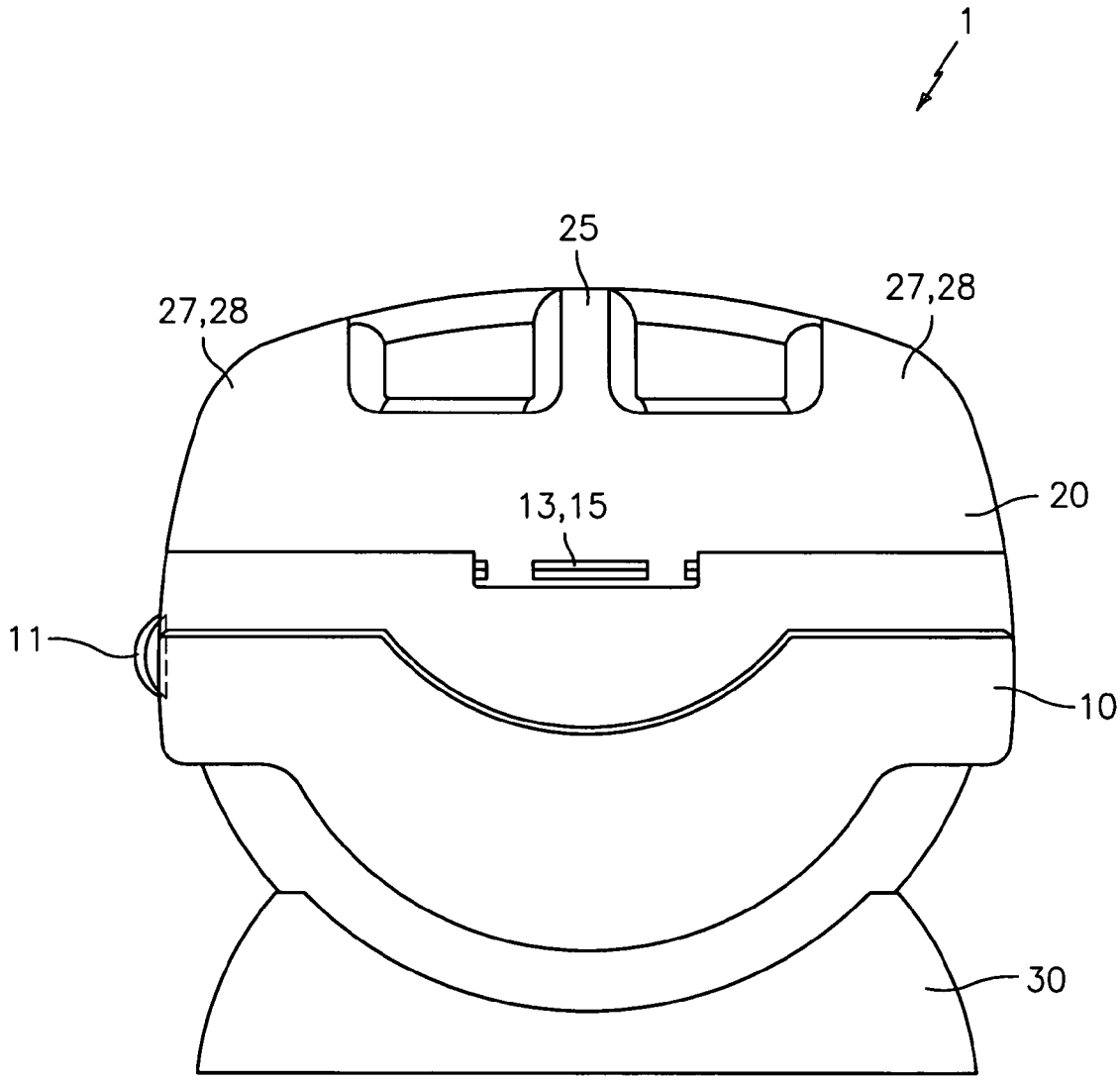
FIG. 4 is a side view of the hair setting assembly of FIG. 1.

Referring to FIGS. 2 through 4, first section 21 and second section 23 preferably are each configured with one or more channels 25, 27, 28 for directing any condensation, accumulating on the under surface of lid 20, into the at least one reservoir disposed in housing 10. Preferably, channel 25 is a central channel 25 and channels 27 and 28 are periphery channels. However, other configurations may also be used in order to accomplish different effects and efficiencies.

Thus, the split lid arrangement heretofore preferably described allows for selective access to rollers 40. This selective access helps to reduce heat loss and improve efficiency.

Figure 5:
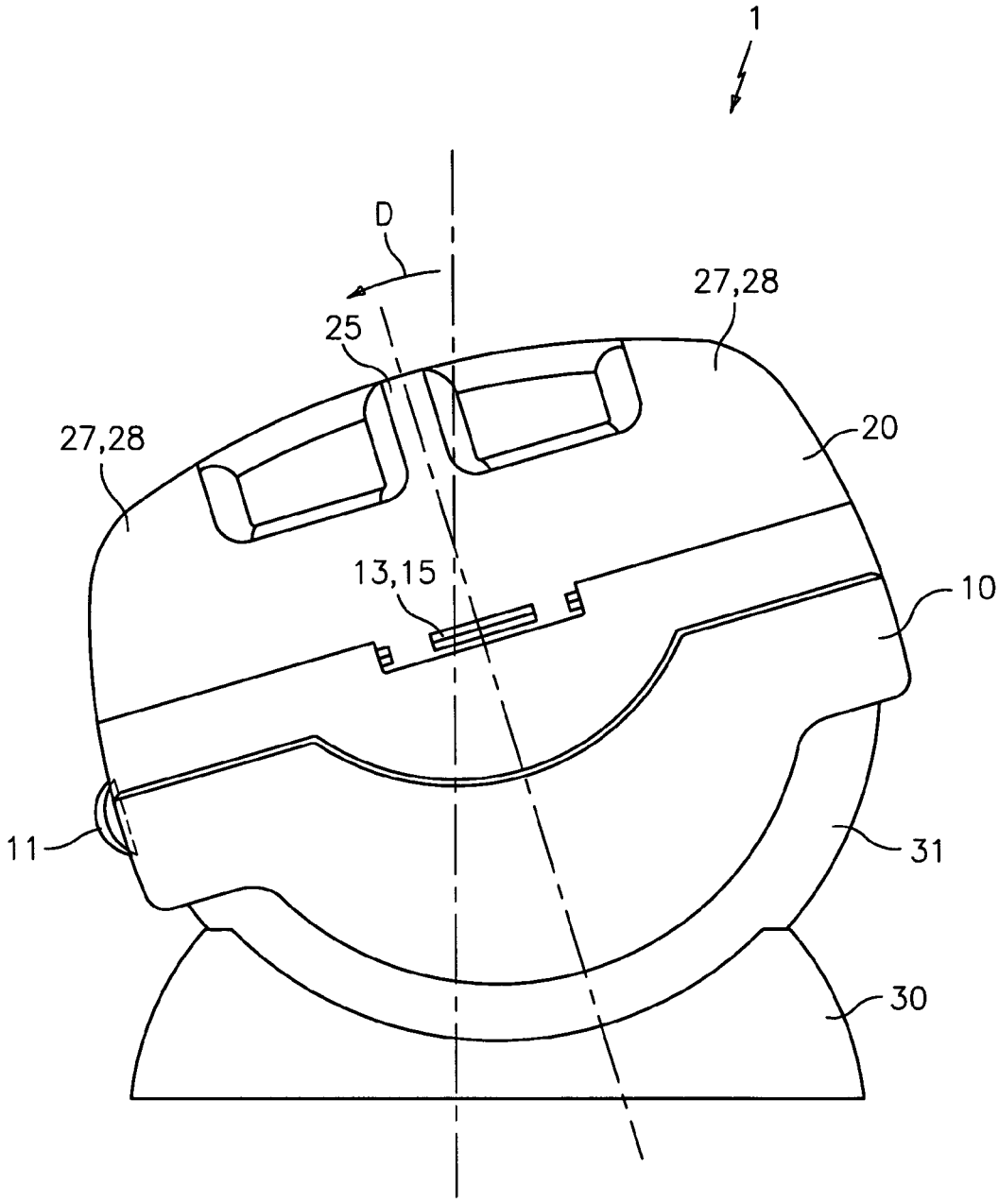
FIG. 5 is a side view of the hair setting assembly of FIG. 4, showing the housing in a tilted position.

Referring to FIG. 5, base 30 preferably is connected to housing 10 such that the housing can be tilted about an axis A in a direction D, through a predetermined angle. Axis A is the axis of the height or vertical extent of the hair setting assembly 1. This tilting action facilitates access to rollers 40 and reduces the risk of a user being burned. Preferably, housing 10 is configured with a lower portion 31 that is shaped to rest snugly on base 30. Preferably, lower portion 31 has at least one slidable connector 33 that cooperates with at least two abutments 32 to control the distance through which the connector can slide. Preferably, base 30 has an upper surface configured to receive and engage lower portion 31 via the slidable connector. Lower portion 31 and base 30 can also be configured to provide a variety of different tilt positions. For example, base 30 could be configured with at least one protrusion 34 that cooperates with one or more spring biased structures 35 independently located between the at two abutments of the slidable connector, to provide for the selective tilt positioning of housing 10 relative to base 30.

The present invention having been thus described with particular reference to the preferred forms thereof, it will be obvious that various changes and modifications may be made therein without departing from the spirit and scope of the present invention as defined herein.

What is claimed is:

1. A hair setting assembly comprising:

a housing supported in a base;

one or more heatable hair rollers removable mounted on supports in said housing; and a lid hingedly mounted to said housing for selectively covering and uncovering said one or more of said heatable hair rollers, said lid having at least two sections that are pivotally connected at opposing ends of said housing wherein each of said at least two sections have one or more channels wherein said one or more channels function to collect accumulated condensation from said lid and direct said condensation to at least one reservoir in said housing, wherein said housing has a longitudinal axis and is capable of tilting in said base about said longitudinal axis through a specified angle to provide access to said heatable rollers.

2. The hair setting assembly of claim 1, wherein said housing is capable of remaining tilted about said longitudinal axis to provide access to said rollers when said lid is in a lifted position.

3. The hair setting assembly of claim 1, wherein said at least two sections seal along a mid-line transverse to said longitudinal axis of said housing.

4. The hair setting assembly of claim 1, wherein said one or more channels are angled to facilitate collection of accumulated condensation from said lid to at least one reservoir in said housing.

5. The hair setting assembly of claim 1, wherein said housing has a lower portion supported on said base for pivotal movement with respect to said base, said housing having one or more supports for supporting one or more heatable hair rollers.

6. The hair setting assembly of claim 1, wherein said housing can be tilted about a horizontal axis of rotation that is perpendicular to the vertical extent of said housing.

7. The hair setting assembly of claim 6, wherein said housing can be tilted about said horizontal axis through a predetermined angle.

8. The hair setting assembly of claim 1, wherein said housing has a lower portion, said lower portion and said base provide different tilt positions.

* * * * *